United States Patent [19]

Van Bogaert et al.

[11] Patent Number: 4,874,018

[45] Date of Patent: Oct. 17, 1989

[54] TRANSMISSION FOR WEAVING LOOMS

[75] Inventors: Philippe Van Bogaert, Schaarbeek; André Vandenbroucke, Langemark, both of Belgium

[73] Assignee: Picanol N.V., Ieper, Belgium

[21] Appl. No.: 312,389

[22] Filed: Feb. 21, 1989

Related U.S. Application Data

[63] Continuation of Ser. No. 33,736, Apr. 3, 1987, abandoned.

[30] Foreign Application Priority Data

Apr. 7, 1986 [NL] Netherlands ..... 8600870

[51] Int. Cl.[4] ..... D03D 51/08

[52] U.S. Cl. ..... 139/1 E; 139/336.4

[58] Field of Search ..... 139/1 R, 1 E, 336 R

[56] References Cited

U.S. PATENT DOCUMENTS 4,553,569 11/1985 Kimbara et al. ..... 139/1 E 4,759,393 7/1988 Kato et al. ..... 139/1 E

FOREIGN PATENT DOCUMENTS 4365 7/1986 World Int. Prop. O. ..... 139/1 E

*Primary Examiner*—Henry S. Jaudon

*Attorney, Agent, or Firm*—Bacon & Thomas

[57] ABSTRACT

A drive system for weaving machines includes normally coupled main and auxiliary drive shafts for at least the batten and heddles of the weaving machine, respectively, with the shafts driven by main and auxiliary drive motors at different speeds through appropriate speed reducers and couplings. The shafts are coupled together at one point by an adjustable coupling that is controllable remotely so as to permit fine adjustment between the relative angular positions of the main and auxiliary drive shafts and therefore between the batten and heddle positions. This system has particular application during weaving machine start-up after a weaving interruption; e.g., when a thread break occurs. Various embodiments are described.

9 Claims, 3 Drawing Sheets

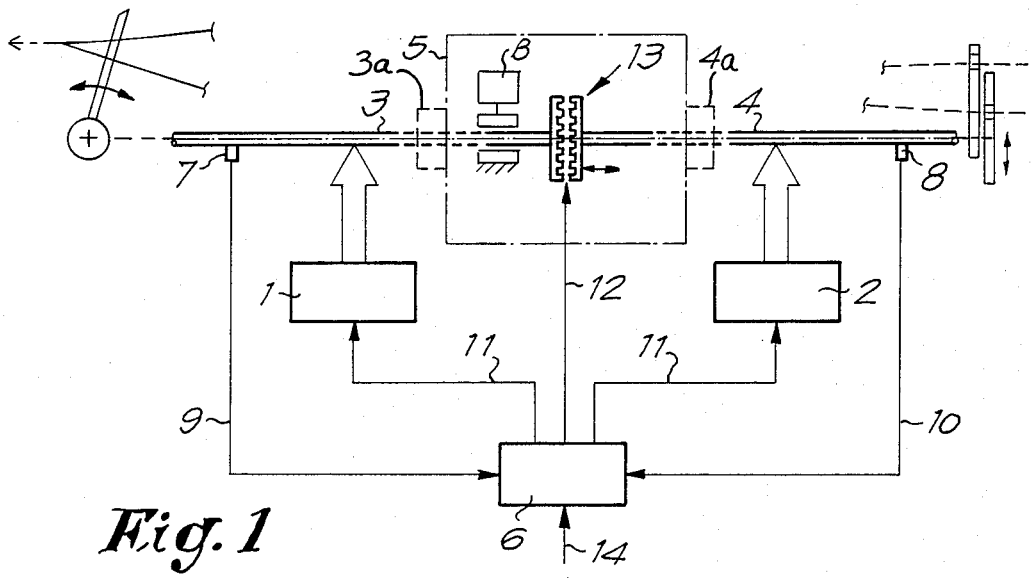
Fig. 1
Fig. 2
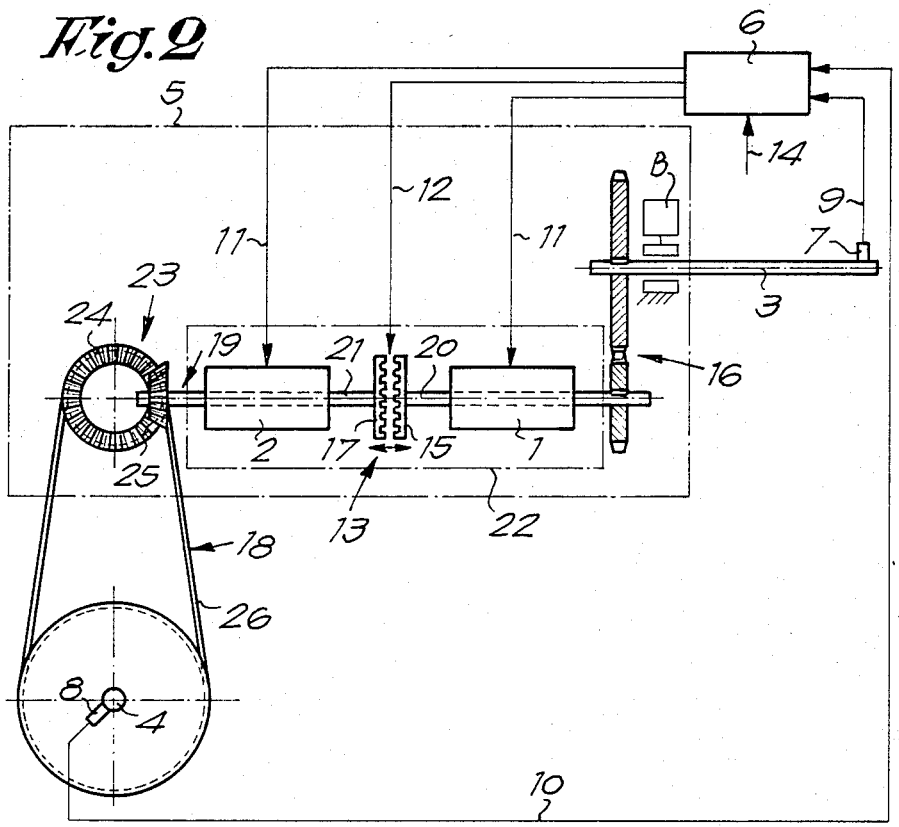

TRANSMISSION FOR WEAVING LOOMS

This application is a continuation, of application Ser. No. 07/033,736, filed 4-3-87, abandoned.

BACKGROUND OF THE INVENTION

The present invention concerns a drive system for weaving machines. More particularly, the invention concerns a drive system comprising a pick finding device which makes it possible to achieve a coupling between the auxiliary shaft and the main shaft of a weaving machine whereby the coupling between these shafts can occur at different angular positions and automatically as a function of an adjustable set value. The "main shaft" is the shaft which drives the batten and, in the case of a gripper weaving machine, also drives the weft gripper drive. The main shaft rotates at the weaving machine speed.

The "auxiliary shaft" is the shaft which drives the shed forming device, i.e., the heddle frames and this auxiliary shaft rotates at one-half the speed of the main shaft.

The objective of the present invention is to provide a drive whereby the crossing moment in time of the heddle frames can be modified relatively easily in relation to the beating up moment in time of the batten, whereby such operation takes place automatically as a function of the adjustment carried out by the weaver after having considered the appearance of the woven cloth.

It is indeed already known that the crossing moment of the heddle frames with respect to the heating up moment of the batten is a decisive factor in weaving machines as far as the appearance of the woven cloth is concerned. Consequently, it is necessary to be able to adjust these values, whereby fine adjustment is possible.

According to a well known method, the auxiliary shaft of the weaving machine, which drives the heddle frames, and the main shaft of the weaving machine which drives the batten, can be manually adjusted relative to each other in order to modify the crossing moment of the heddle frames with respect to the beating up moment of the batten. This operaton is achieved, for instance, by means of a pick finding device comprising a belt pulley or of a gear wheel that is rotated with respect to the shaft after loosening the clamp connection or, for instance, by shifting a toothed belt over a few teeth, or, in the case of a gear transmission, by shifting the tooth gears over a few teeth in relationship to each other and to engage them afterwards. Quite obviously, this method involves time losses for these mounting and assembling operations.

It is also well known that methods are designed for pick finding devices whereby the main shaft and the auxiliary shaft are always coupled with each other in locked relationship. In this environment, clutch couplings are used which make coupling possible only for a specific mutual position of the main and auxiliary shafts. Clearly, such pick finding devices have the disadvantage that they do not enable the automatic adjustment of the crossing moment of the heddle frames with respect to the heating up moment of the batten.

SUMMARY OF THE INVENTION

The objection of the present invention is to provide a drive means for weaving machines whereby the crossing moment of the heddle frames can be modified relative to the heating up moment of the batten and whereby this occurs according to the invention by means of a fully automatic control of the pick finding device in response to a set value.

Another advantage of the invention resides in the fact that the shaft whereon the coupling element of the pick finding device is mounted need not necessarily rotate at the weaving machine speed or at the speed of the auxiliary shaft. According to a preferred embodiment of the invention, the coupling elements of the pick finding device are mounted on shafts which normally rotate at higher speeds than the speed of the main shaft. This system is advantageous because, due to the higher speed of said coupling elements, a smaller moment of torque need be transmitted to the coupling.

Still another advantage of this embodiment whereby the coupling element of the pick finding device is rotated at a higher speed than the main shaft of the weaving machine, results from the fact that such pick finding device system is particularly suitable to achieve the automatic adjustment discussed above.

With this objective, the drive means for the weaving machine in accordance with the invention comprises, in combination, a main drive motor means, an auxiliary drive motor means, a main shaft, an auxiliary shaft and a pick finding device that can selectively achieve coupling and uncoupling between the main shaft and the auxiliary shaft, whereby the coupling can occur over a range of mutually different fine positions of the main shaft and of the auxiliary shaft; of detection means for determining the difference between the angle of positions of the main shaft relative to the auxiliary shaft, and of a control unit which controls the pick finding device and at least one of the drive motor means to create an automatic coupling between the main shaft and the auxiliary shaft as a function of a preselected set value for the angulardifference.

The pick finding device used to this end will preferably be equipped with a coupling element that is mounted on a shaft rotating at a higher speed than the speed of the main shaft and the speed of the auxiliary shaft. To this end, the pick finding device will be preferably composed of a coupling element including two parts, the first part being coupled by means of a first drive train with the main shaft of the weaving machine and the second part being coupled by means of a second drive train with the auxiliary shaft, whereby the speed ratios of the drive trains are chosen in such a way that the coupling element has a higher rotational speed than the rotational speeds of said main shaft and said auxiliary shaft. Quite obviously, due to the fact that the coupling element rotates at a higher speed than the main shaft and the auxiliary shaft, an advantage is obtained in that many selections for the mutual coupling of the main shaft and the auxiliary shaft are made possible, particularly if the aforesaid coupling element has an inherently limited number of coupling positions.

The main drive motor means and the auxiliary drive motor means will be preferably mounted respectively adjacent and alongside the coupling element. In this way, a central location of both drive means is obtained between the aforesaid first and second drive trains. Such a central position is advantageous because the main drive motor means and the auxiliary drive motor means, the coupling element of the pick finding device and possibly a brake can be included within one single assembly. To this end, an electromagnetic coupling can be used for achieving the necessary mutual couplings between the various parts. Such a coupling is described in U.S. Pat. No. 4,592,392 assigned to the owner of this patent application.

DESCRIPTION OF THE DRAWING

In order to achieve a better understanding of the characteristics of the invention, a few preferred embodiments will be described hereafter by way of examples without any limitative character and with reference to the figures described as follows:

FIG. 1 shows a schematic view of the drive system in accordance with the invention;

FIG. 2 shows a view of one embodiment of the invention whereby the main drive motor means and the auxiliary drive motor means as well as the coupling element of the pick finding device are mounted on a shaft which rotates at a higher speed than the speed of the main and auxiliary shafts;

DETAILED DESCRIPTION OF PREFERRED EMBODIMENTS

Figure 3:
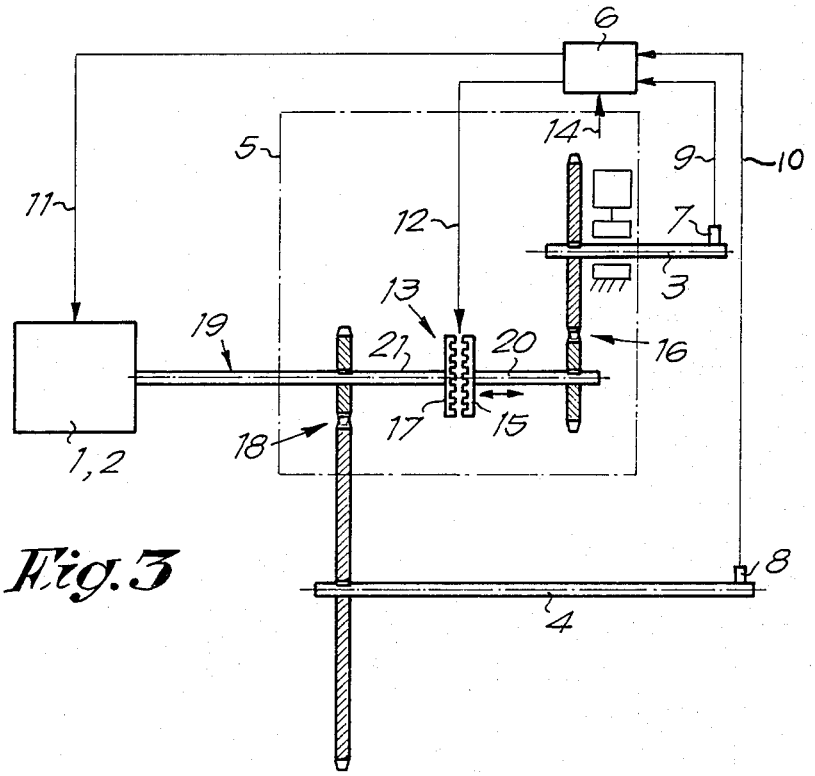
FIG. 3 shows an alternative embodiment of the drive system in accordance with the invention.
Figure 5:
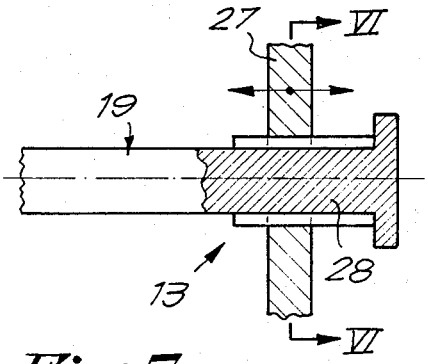
FIG. 5 is an enlarged view of the part of FIG. 4 which is indicated by F5.
Figure 6:
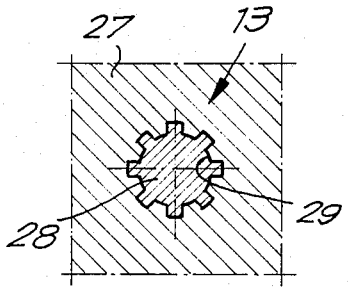
FIG. 6 is a sectional view taken along line VI—VI of FIG. 5.

As illustrated in the Figures, the drive for weaving machines comprises a main drive motor means 1; an auxiliary drive motor means 2; a main shaft 3 which drives the batten and possibly also the weft gripper drive in the case of a gripper weaving machine; an auxiliary shaft 4 which drives the heddle frames; and a pick finding device 5, and appropriate means (i.e., speed reducers or transmissions 3*a* and 4*a* for accommodating the different shaft speeds). The pick finding device 5 renders it possible to uncouple the main shaft 3 and the auxiliary shaft from each other while the heddle frames can be driven by means of the auxiliary shaft 4 that is driven by the auxiliary drive motor means 2.

According to the present invention, a pick finding device 5 is used which makes it also possible to achieve mutual coupling of the main shaft 3 and of the auxiliary shaft 4 at many different relative angular positions and wherein, as schematically illustrated in FIG. 1, switching on of the coupling is automatically achieved by means of a control unit 6 in such a way that the pick finding device 5 achieves coupling between the main shaft 3 and the auxiliary shaft 4 in accordance with a preselected set value. The preselected set value, of course, would correspond to that desired angular relationship between the main and auxiliary shafts that will establish the desired crossing moment of the heddle frames relative to the beating up moment of the batten. Such a value, as is known, may depend on the variables associated with each weaving machine, the nature of the threads being woven, the speed of weaving, and so forth. However, once the value is known, it may be established as a set point for the angular relationship between the shafts 3 and 4. This invention permits setting this angular relationship without manual adjustment of the relative angular positions of the shafts.

As illustrated in FIGS. 1 to 4, angular detection means, respectively 7 and 8, are associated with the main shaft 3 and the auxiliary shaft 4, and comprise, for instance, angle detectors which detect or determine the relative angular position of the shafts. The angular position signals from these detection means 7 and 8 are transmitted through lines 9 and 10 to the control unit 6. Control lines 11 extend from the control unit 6 to the auxiliary drive motor means 2 and possibly also to the main drive motor means 1, and also line 12 extends to a coupling control mechanism (not illustrated per se in the Figures) for transmitting coupling locking signals as well as main and auxiliary motor drive control signals for controlling operation of the main and auxiliary motor drive means and for switching on or off (i.e., locked or unlocked, respectively) the coupling element 13 of the pick finding device 5. Moreover, a preselected set value 14 can be supplied to the control unit 6, said value representing the desired difference between the angular positions of the main shaft 3 and of the auxiliary shaft 4 at the moment of the next switching on of the coupling 13 of pick finding device 5.

The operation of the drive system in accordance with the invention is essentially as follows:

In case of a break of a weft or warp thread, the machine is stopped in a known manner and the defective thread is removed from the shed.

Clearly, the weft pattern will be interrupted by this stoppage if no pick finding is carried out. To this end, as already known, the coupling element 13 is switched "off" or unlocked and the auxiliary shaft 4 is driven backwards by means of the auxiliary drive motor means 2 until the auxiliary shaft 4 is brought to a desired angular relationship with the main shaft. According to the present invention, the auxiliary drive motor 2 will be automatically switched on or locked by means of a coupling locking signal supplied by the control unit 6 until this condition is obtained whereby the difference between the angular positions of the main shaft 3 and the auxiliary shaft 4 which are measured by the detection means 7 and 8 is equal to the desired difference which is equal to the selected set value 14. At the moment that the right mutual angular position between the main shaft 3 and the auxiliary shaft 4 is achieved, the coupling element 13 is automatically switched on or locked.

Quite obviously, the use of a pick finding device 5 which makes it possible to lock the main shaft 3 and the auxiliary shaft 4 according to a many different mutual positions and, on the other hand, the use of a control unit 6 renders manual adjustments of the shafts unnecessary with the advantage that the crossing moment of the heddle frames can easily be modified in relationship with the beating up moment of the batten.

FIGS. 2–6 illustrate by way of examples a few preferred embodiments of the drive system which is equipped with the pick finding device and which are particularly suitable for establishing an automatic coupling of the shafts 3 and 4 with many positions and a drive system which provides other advantages.

In FIGS. 2 and 3, the pick finding device 5 essentially comprises a coupling element 13, the first part 15 of which is coupled to the main shaft 3 by means of a first reduction gearset (i.e., transmission) 16 and the second part 17 of this is coupled with the auxiliary shaft 4 by means of a second reduction gearset (i.e., transmission) 18. The speed reduction ratios of both gearsets are chosen in such a way that, when the coupling element 13 is switched on, the coupling element 13 will rotate at a higher speed that the speeds of the main shaft 3 and the auxiliary shaft 4 of the weaving machine.

The speed reduction ratios of the gearsets 16 and 18 will be generally chosen with respect to each other in such a way that, as is already known, the shafts 3 and 4 rotates at the normal speed for working conditions of the weaving machine with shaft 3 rotating at is twice the rotational speed of the auxiliary shaft 4.

In the embodiment according to FIG. 2, the coupling element 13 is mounted on intermediate shaft assembly 19 that comprises two shaft parts 20 and 21, which are equipped on their opposing adjacent ends with coupling element 13 which includes parts 15,17. The main drive motor means 1 and the auxiliary drive motor means 2 are respectively mounted on intermediate shaft parts 20 and 21 in such a way that they are located between the corresponding coupling parts, respectively 15 and 17, and the gearsets 16 and 18. In this way, the advantage is obtained in that the whole system including the drive motor means 1 and 2 and the coupling element 13 can be designed as a compact assembly 22. Another advantage is that the drive means 1 and 2 are centrally mounted between the main shaft 3 and the auxiliary shaft 4 whereby the complexity of the drive trains is simplified.

The aforesaid assembly 22 preferably includes electromagnetic couplings which enable the main drive motor means 1 or the auxiliary drive motor means 2 or a brake B associated, for example, with shaft 3, arranged to be electrically switched on or off.

The reduction gearset 18 is composed in the embodiment according to FIG. 2 of the combination of a gear coupling 23 comprising two conical gears 24 and 25 and a belt drive 26. The aforesaid coupling element 13 is made in this case, for instance, of a clutch coupling which can be engaged at many angular positions of the shaft parts 20,21.

During operation of the drive system in accordance with FIG. 2, in case of a breakage of thread, the main drive motor means 1 is switched off, and the aforesaid brake B is actuated. In this way, the main shaft 3 as well as the auxiliary shaft 4 are stopped within a short time. Then the coupling element 13 is unlocked and the defective thread is removed.

Before weaving is ready to be resumed the shaft part 21 is first rotated back by means of the auxiliary drive motor means 2 in such a way that the auxiliary shaft 4 is brought to a position corresponding to the desired set value 14 supplied to the control unit 6. This is automatically determined by control unit 6 and by means of the detectors 7 and 8.

The control unit 6 then causes the switching off of the auxiliary drive motor means 2, the switching on or locking of the coupling element 13 and finally the switching on of the main drive motor means 1 to resume weaving.

It is to be noted that the auxiliary drive motor means 2 comprises a drive means which is also designed to achieve slow running of the weaving loom it is switched on coupling 13 locked.

It is also clear that, in the case of a pick finding device 5, as illustrated in FIG. 2, the coupling element 13 rotates at a higher speed compared with the rotational speed of the main shaft 3 and the auxiliary shaft 4. This provides an advantage in that the main shaft 3 and the auxiliary shaft 4 can be coupled to each other at many possible relative angular positions, which is particularly suitable for achieving an automated drive system.

FIG. 3 illustrates an alternative embodiment of the drive in accordance with the invention. In this case, the speed reduction gearset or transmission 18 comprises, on the one hand, a conventional gear transmission while, on the other hand, the drive motor means 1 and the auxiliary drive motor means 2 constitute a unitary or common system cooperating with the shaft part 21. The main drive motor means 1 and the auxiliary drive motor means 2 can be embodied in different ways. According to a preferred embodiment, but not specifically illustrated in detail, the drive system includes within 1,2 the motor means, coupling parts, an electromagnetic coupling, a brake and separate coupling parts used for the main drive motor means 1 and the auxiliary drive motor means 2.

Clearly, the main drive motor means 1 and the auxiliary drive motor means 2, according to the embodiment of FIG. 3, can be also made of a single motor capable of running at the normal speed of the weaving machine as well as the slow run speed of the machine.

The working of the drive system according to FIG. 3 is essentially similar to that of FIG. 2 and can be readily understood from the drawing, wherein like reference numerals designate corresponding elements.

Figure 4:
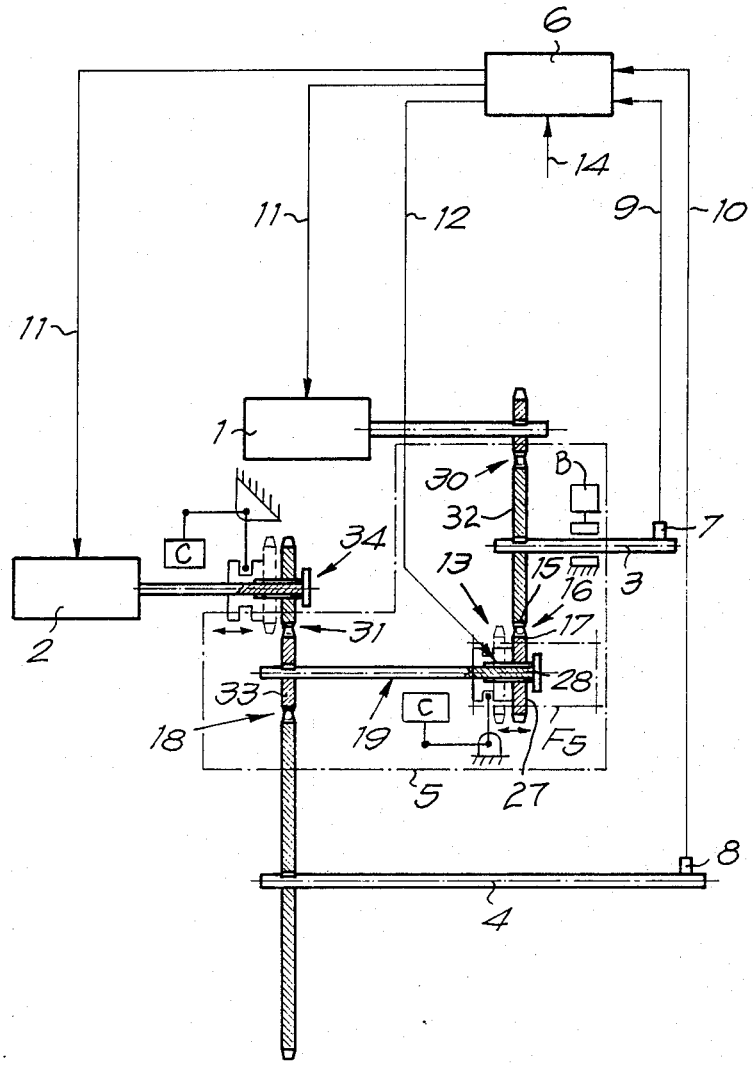
FIG. 4 shows still another alternative embodiment of the drive system in accordance with the invention.

FIG. 4 illustrates still another embodiment of the drive in accordance with the invention, whereby the coupling element 13 cooperates with a gear 27 of the aforesaid gearset or transmission 16. As illustrated in detail in FIS. 5 and 6, the shaft 19 is equipped with a splined end 28 in such a way that the gear 27 which is equipped with splines 29 can be axially shifted along the end 28 of the shaft.

The locking and the unlocking of the coupling element 13 is achieved in this case, for instance, by axially shifting the gear 27 until gears 27 and 32 are uncoupled from each other. This result is indeed automatically achieved by means of a switching mechanism (not illustrated in FIG. 4) which is actuated by the control unit 6. The aforesaid first part 15 and the second part 17 of the coupling element 13 in this case correspond with the gears 27 and 32 of the gearset or transmission 16.

As also illustrated in FIG. 4, gear coupling 30 and movable gear coupling 31 can also be used for coupling the main drive motor means 1 and the auxiliary drive motor means 2 with the gears 32 and 33 of the gearsets or transmissions 16 and 18. In this way, it becomes possible to drive motor means 1 and 2 at higher rotational speeds than the speeds of shafts 3 and 4. Consequently, the torque requirements of motors 1 and 2 can be kept limited.

The additional gearset 31 between the auxiliary drive motor means 2 and the shaft 19 offers the possibility for providing a second gear coupling element 34, wherein the auxiliary drive motor means 2 can be completely uncoupled from the shaft 19. The coupling element 34, of course, also can be designed for instance in the same way as the coupling element 13 already illustrated in FIGS. 5 and 6.

Clearly, all aforesaid gearsets or transmissions 16, 18, 30 and 31 may be made of gears, belts, conical gears or combinations of these elements. The pick finding device 5 and more particularly the coupling element 13 need not necessarily be a clutch coupling but may also comprise a continuously variable coupling element.

In addition, all the aforesaid embodiments can be provided with a conventional locking or brake device B for preventing rotation of the main shaft 3, such locking device being mounted on shaft 3 and capable of being switched on or switched off in a conventional manner.

The present invention is by no means limited to the embodiments described by way of examples and illustrated by the Figures in appendix, but this drive system may also be used for weaving machines and for their pick finding devices with any shape and size without departing from the scope of the invention.

We claim:

1. In a drive system for weaving machines including a main drive shaft for the machine batten arranged to be rotated at a first drive speed, an auxiliary drive shaft for the machine heddles arranged to be rotated at a second drive speed, said main and auxiliary drive shafts connected together through a coupling means for synchronous rotation at selected rotational angular positions relative to each other, the improvement comprising:

said coupling means arranged to be remotely controlled between locked and unlocked condition responsive to coupling locking signals, said main and auxiliary drive shafts being locked against relative rotation when the coupling means is locked and relatively rotatable when the coupling means is unlocked, and said coupling means being arranged to lock and unlock said main and auxiliary drive shafts at a large number of different relative angular positions;

a coupling control means for controlling locking and unlocking of said coupling means;

a main and auxiliary drive motor means connected in driving relationship with the main and auxiliary drive shafts, respectively, operation of said drive motor means being controlled at least in part by main and auxiliary motor drive control signals;

angular position detecting means for determining the relative angular positions of said main and auxiliary drive shafts and for generating angular position signals related to the detected relative angular positions of the shafts;

said coupling control means arranged to receive said angular position signals; to receive a set value corresponding to the desired angular relationship between said main and auxiliary drive shafts; and to generate said coupling locking signals and said main and auxiliary motor drive control signals in response thereto;

whereby said main and auxiliary drive shafts can be uncoupled from each other at the coupling means, rotated relative to each other by at least one drive motor means and recoupled at the coupling means in a different relative angular relationship corresponding to a set value under the control of said coupling control means.

2. The improvement as claimed in claim 1, including speed ratio changing means between the main and auxiliary drive shafts, on the one hand, and the coupling means on the other hand, said speed ratio changing means arranged so that the coupling means rotates at a higher speed than both the main and auxiliary drive shafts.

3. The improvement as claimed in claim 2, said coupling connected between intermediate shaft parts connected to said main and auxiliary drive shafts, said main and auxiliary drive motor means arranged to rotate said intermediate shaft parts at the rotational speed of the coupling means when the coupling means is locked.

4. The improvement as claimed in claim 3, wherein said intermediate shaft parts, coupling means and drive motor means comprise a single assembly.

5. In a drive system for weaving machines including a main drive shaft for the machine batten arranged to be rotated at a first drive speed, an auxiliary drive shaft for the machine heddles arranged to be rotated at a second drive speed, said main and auxiliary drive shafts connected together through a coupling means for synchronous rotation at selected rotational angular positions relative to each other, the improvement comprising:

said coupling means arranged to be remotely controlled between locked and unlocked condition responsive to coupling locking signals, said main and auxiliary drive shafts being locked against relative rotation when the coupling means is locked and relatively rotatable when the coupling means is unlocked, and said coupling means being arranged to lock and unlock said main and auxiliary drive shafts at a large number of different relative angular positions;

a coupling control means for controlling locking and unlocking of said coupling means;

said main and auxiliary drive shafts being connected to each other through intermediate shafting including a plurality of intermediate shaft parts connected respectively to said main and auxiliary drive shafts, including at least a first intermediate shaft part connected to the main drive shaft and a second intermediate shaft part connected to the auxiliary drive shaft, with said coupling means disposed between said first and second intermediate shaft parts;

speed ratio changing means disposed between the main and auxiliary drive shafts and the intermediate shaft parts;

a main drive motor means connected in driving relationship with said first intermediate shaft part; and auxiliary drive motor means connected in driving relationship with said second intermediate shaft part, operation of said drive motor means being controlled at least in part by main and auxiliary motor drive control signals;

angular position detecting means for determining the relative angular positions of said main and auxiliary drive shafts and for generating angular position signals related to the detected relative angular positions of the shafts;

said coupling control means arranged to receive said angular position signals; to receive a set value corresponding to the desired angular relationship between said main and auxiliary drive shafts; and to generate said coupling locking signals and said main and auxiliary motor drive control signals in response thereto;

whereby said main and auxiliary drive shafts can be uncoupled from each other at the coupling means, rotated relative to each other by at least one drive motor means and recoupled at the coupling means in a different relative angular relationship corresponding to a set value under the control of said coupling control means.

6. In a drive system for weaving machines including a main drive shaft for the machine batten arranged to be rotated at a first drive speed, an auxiliary drive shaft for the machine heddles arranged to be rotated at a second drive speed, said main and auxiliary drive shafts connected together through a coupling means for synchronous rotation at selected rotational angular positions relative to each other, the improvement comprising:

said coupling means arranged to be remotely controlled between locked and unlocked condition responsive to coupling locking signals, said main and auxiliary drive shafts being locked against relative rotation when the coupling means is locked and relatively rotatable when the coupling means is unlocked, and said coupling means being arranged to lock and unlock said main and auxiliary drive shafts at a large number of different relative angular positions;

a coupling control means for controlling locking and unlocking of said coupling means;

said main and auxiliary drive shafts being connected to each other through intermediate shafting including a plurality of intermediate shaft parts connected respectively to said main and auxiliary drive shafts;

speed ratio changing means disposed between the main and auxiliary drive shafts and the intermediate shaft parts;

said coupling means associated with the intermediate shafting between intermediate shaft parts;

at least one drive motor means drivingly connected to one of the intermediate shaft parts, said drive motor means arranged to be rotatable at a slow speed when the coupling is unlocked and at a higher speed when the coupling is locked, said one drive motor means being controllable at least in part by a motor drive control signal;

angular position detecting means for determining the relative angular positions of said main and auxiliary drive shafts and for generating angular position signals related to the detected relative angular positions of the shafts;

said coupling control means arranged to receive said angular position signals and to receive a set value corresponding to the desired angular relationship between said main and auxiliary drive shafts and to generate said coupling locking signals and said motor drive control signal in response thereto;

whereby said main and auxiliary drive shafts can be uncoupled from each other at the coupling means, rotated relative to each other at the second drive speed by the drive motor means and recoupled at the coupling means in a different relative angular relationship corresponding to a set value under the control of said coupling control means.

7. In a drive system for weaving machines including a main drive shaft for the machine batten arranged to be rotated at a first drive speed, an auxiliary drive shaft for the machine heddles arranged to be rotated at a second drive speed, said main and auxiliary drive shafts connected together through a coupling means for synchronous rotation at selected rotational angular positions relative to each other, the improvement comprising:

said coupling means arranged to be remotely controlled between locked and unlocked condition responsive to coupling locking signals, said main and auxiliary drive shafts being locked against relative rotation when the coupling means is locked and relatively rotatable when the coupling means is unlocked;

a coupling control means for controlling locking and unlocking of said coupling means;

said main and auxiliary drive shafts being connected to each other through intermediate shafting including a plurality of intermediate shaft parts connected respectively to said main and auxiliary drive shafts;

said main and auxiliary drive motor means connected to one of the intermediate shaft parts, said main and auxiliary drive motor means being controlled at least in part by motor drive control signals;

angular position detecting means for determining the relative angular positions of said main and auxiliary drive shafts and for generating angular position signals related to the detected relative angular positions of the shafts;

said coupling control means arranged to receive said angular position signals and to receive a set value corresponding to the desired angular relationship between said main and auxiliary drive shafts and to generate said coupling locking signals and motor drive control signals in response thereto;

whereby said main and auxiliary drive shafts can be uncoupled from each other at said coupling means, rotated relative to each other by at least one drive motor means and recoupled at said coupling means in a different relative angular relationship corresponding to a set value under the control of said coupling control means.

8. The improvement as claimed in claim 7, wherein said main and auxiliary drive motor means connected to an intermediate shaft part that is connected to the auxiliary drive shaft between the coupling means and the auxiliary drive shaft.

9. In a drive system for weaving machines including a main drive shaft for the machine batten arranged to be rotated at a first drive speed, an auxiliary drive shaft for the machine heddles arranged to be rotated at a second drive speed, said main and auxiliary drive shafts connected together through a coupling means for synchronous rotation at selected rotational angular positions relative to each other, the improvement comprising:

said main and auxiliary drive shafts connected to each other through at least one selectively engageable transmission, said transmission constituting said coupling means and being arranged to be remotely controllable between engaged and disengaged positions responsive to coupling locking signals, said main and auxiliary shafts being locked against relative rotation when the coupling means is locked and relatively rotatable when the coupling means is unlocked;

a coupling control means for controlling locking and unlocking of said coupling means;

a main and auxiliary drive motor means connected in driving relationship with the main and auxiliary drive shafts, respectively, operation of said drive motor means being controlled at least in part by main and auxiliary motor drive control signals;

angular position detecting means for determining the relative angular positions of said main and auxiliary drive shafts and for generating angular position signals related to the detected relative angular positions of the shafts;

said coupling control means arranged to receive said angular position signals and to receive a set value corresponding to the desired angular relationship between said main and auxiliary drive shafts and to generate said coupling locking signals and said motor drive control signals in response thereto;

whereby said main and auxiliary drive shafts can be uncoupled from each other at said coupling means, rotated relative to each other by at least one drive motor means and recoupled in a different relative angular relationship corresponding to a set value under the control of said coupling control means.

* * * * *

UNITED STATES PATENT AND TRADEMARK OFFICE

CERTIFICATE OF CORRECTION

PATENT NO. : 4,874,018

DATED : October 17, 1989

INVENTOR(S) : Philippe Van Bogaert and Andre Vandenbroucke

It is certified that error appears in the above-identified patent and that said Letters Patent is hereby corrected as shown below:

On the title page, item [54] and in column 1, line 2:

Please correct the title of the invention to read:

"DRIVE SYSTEM FOR WEAVING MACHINES"

Signed and Sealed this

Fifteenth Day of January, 1991

*Attest:*

HARRY F. MANBECK, JR.

*Attesting Officer*

*Commissioner of Patents and Trademarks*